United States Patent [19]

Slomma et al.

[11] Patent Number: 4,485,752

[45] Date of Patent: Dec. 4, 1984

[54] ADJUSTABLE NEEDLE BAR CRANK DRIVE

[75] Inventors: Heinz-Georg Slomma, Viersen; Hans-Gerd Ripkens, Goch, both of Fed. Rep. of Germany

[73] Assignee: Maschinenfabrik Carl Zangs Aktiengesellschaft, Krefeld, Fed. Rep. of Germany

[21] Appl. No.: 244,455

[22] Filed: Mar. 16, 1981

[30] Foreign Application Priority Data

Mar. 21, 1980 [DE] Fed. Rep. of Germany ..... 3010840

[51] Int. Cl.[3] ..... D05C 11/06; D05B 55/14

[52] U.S. Cl. ..... 112/221; 112/79 A

[58] Field of Search ..... 112/221, 220, 79 A, 112/98

[56] References Cited

U.S. PATENT DOCUMENTS

| | | | |
|---|---|---|---|
| 2,100,844 | 11/1937 | Foster | 112/221 X |
| 2,662,495 | 12/1953 | Parry | 112/221 X |
| 2,692,569 | 10/1954 | Ketterer | 112/221 X |
| 3,438,347 | 4/1969 | Taketomi | 112/221 X |
| 3,450,081 | 6/1969 | Rabinow | 112/221 |
| 3,492,959 | 2/1970 | Wenz et al. | 112/221 |
| 3,633,523 | 1/1972 | Card | 112/79 A |
| 3,748,914 | 7/1973 | Parsons | 112/221 X |
| 4,190,006 | 2/1980 | Mellor | 112/221 X |
| 4,254,772 | 3/1981 | Minella et al. | 112/221 |

FOREIGN PATENT DOCUMENTS

| | | | |
|---|---|---|---|
| 4537266 | 11/1970 | Japan | 112/220 |
| 364473 | 1/1932 | United Kingdom . | |

*Primary Examiner*—Werner H. Schroeder
*Assistant Examiner*—Andrew M. Falik
*Attorney, Agent, or Firm*—Martin A. Farber

[57] ABSTRACT

A device for driving at least one needle bar on embroidery or sewing machines from a main drive shaft by means of a crank drive. In order to create a simple construction of high efficiency, low noise and little wear, the axis of rotating of the crank mechanism is arranged parallel to the main drive shaft. The bearing for defining the axis of rotation of the crank mechanism is adjustable in height such that the magnitude of the stroke of the needle is unchanged.

21 Claims, 7 Drawing Figures

ADJUSTABLE NEEDLE BAR CRANK DRIVE

The present invention relates to a device for driving at least one needle bar on embroidery or sewing machines in general. In particular the invention relates to a device for driving at least one needle bar on embroidery or sewing machines having a main drive shaft which extends at a right angle to the longitudinal axis of the needle bar and parallel to the front side of the machine and by which drive shaft, by means of a drive carriage, which drive carriage is guided parallel to the longitudinal axis of the needle, the needle can be driven by means of a crank drive, which crank drive comprises a connecting rod, which drives the drive carriage back and forth, and a crank which is operatively rotatingly driven by the main drive shaft.

In the known driving device (German OS No. 2 206 925—and corresponding British Pat. No. 1,350,372) an intermediate oscillating shaft, by means of a connecting rod, is moved back and forth by a crank disc which is fastened on the main drive shaft. On this oscillating shaft, in turn, a crank is attached, which with a crank pin engages a driving lever, which is swingably mounted at the rear end on a swinging crank lever and at the front, forked end, on the one hand, is longitudinally displaceably guided on a needle guide bar, and on the other hand supports a needle holder for the needle.

Consequently the needle performs a pure back and forth movement, which, by means of the oscillating of the oscillating lever with respect to stroke, can be extended upwardly. This known design thereby makes possible a changing of the length of the stroke of the needle, without however changing its point of reversal at the lower end of the stroke movement.

The object of the present invention is to create with simple means the ability in a device of this type to achieve a displacement of the stroke path, specifically with the stroke length of the needle movement remaining the same, such that merely the two points of reversal of movement of the needle bar are displaceable in the direction of movement of the needle bar during stopping as well as during driving.

In other words, with the present invention, with the stroke length remaining the same, the stroke movement as a whole is to be shifted, so that not only is a change in the depth of penetration made possible but also a displacement such that the needle or the borer of the machine no longer penetrates into the cloth, so that so-called jump stitches can be performed without disconnecting the needle bar mechanism.

In accordance with the present the bearing of the axis (5*a*) of rotation of the crank (5), which axis is parallel to the main drive shaft (2), is vertically displaceable with the magnitude of its stroke remaining constant.

The advantages of this are as follows:

There is created a driving device with which there is possible a change of the depth of penetration of the needles or borers that are to be attached on the needle bar of embroidery or sewing machines, whereby in particular in conical borers the diameter of the hole produced in each case can be changed continuously, that is steplessly. Furthermore by the construction according to the present invention, it is possible to displace the stroke, which remains constant in its magnitude, in such manner that the needle or borer no longer penetrates into the cloth, so that the so-called jump stitches can be accomplished without switching off or disconnecting the needle-bar drive.

In one embodiment according to the present invention, the crank (5) is supported on a rocker (11) which is pivoted around the axis (2*a*) of rotation of the main drive shaft (2). This provides the advantage that the distance between the axis of rotation of the crank wheel (5) and the axis (2*a*) of rotation of the main drive shaft (2) does not change during a vertical displacement of the crank wheel (5). In this manner length-equalizing elements are not necessary and can be dispensed with. The rocker (11) is preferably swung by means of a displacement eccentric (12) which at the same time fixes the rocker in position.

In an alternative embodiment of the present invention (cf. FIGS. 6 and 7), the crank (5) is mounted on a mounting member (15) which is vertically displaceable on at least one mounting bar (8). The displacement of the crank wheel (5) can be effected by means of mechanical, hydraulic or electrical devices, and specifically, either indirectly or directly via redirecting gears. A further advantageous feature is that for the vertical displacement of the mounting member (15) which supports the crank wheel (5), two mounting bars (8) are arranged parallel to the needle bar (9) so that the stroke displacement of the needle bar is identical with the vertical displacement of the mounting member of the crank wheel.

In accordance with further features of the present invention, the crank (5) of the main drive shaft 2 can be actuated by means of a toothed belt (4), a chain (14) or a gearwheel mechanism (3, 13, 5).

The device according to the present invention is particularly well suited for driving the specifically selected needle bar of a multi-needle embroidery or sewing machine. There are known per se from German OS No. 2 749 700 embroidery or sewing machines of this type having a plurality of the needle bars which are mounted parallel to each other in a needle bar carrier, which needle bar carrier is displaceably mounted transversely to the embroidery direction. By means of a coupling member, one of the needle bars at a time can be coupled to the drive carriage, the latter being guided on a guide bar, the guide rod extending parallel behind the needle bars. Further cooperating with this per se known device a further feature of the device of the present invention is that in the highest position of the vertically displaceable bearing for the axis of rotation (5*a*) of the crank (5), the coupling members (9*a*) of those needle bars (9) which are respectively at the time disconnected from the drive carriage (7), are able to be transferred to a stationary holding rail (19) which is arranged parallel to the movement direction of the needle bar carrier.

The formation according to the present invention thus makes possible the vertically displaceable arrangement of the bearing of the crank in multi-needle machines, by means of transferring, into their highest position, the needle bars (9) which are disconnected from the drive carriage (7) and by subsequent lateral displacement of the needle bar carrier (10), to secure them on the stationary holding rails (19) such that the displacement of the stroke path according to the present invention can be simultaneously used for the purpose of bringing the uncoupled needle bars into a rest position and to hold them in this rest position. Like the selection of the respective needles that are to be driven, the stroke path displacement and the securing of the uncoupled needles in the rest position can also be effected by means of a motor-driven setting drive which, for instance, can be centrally controlled by a punch tape of the machine.

With the above and other objects and advantages in view, the present invention will become more clearly understood in connection with the detailed description of preferred embodiments, when considered with the accompanying drawings, of which:

Figure 1:
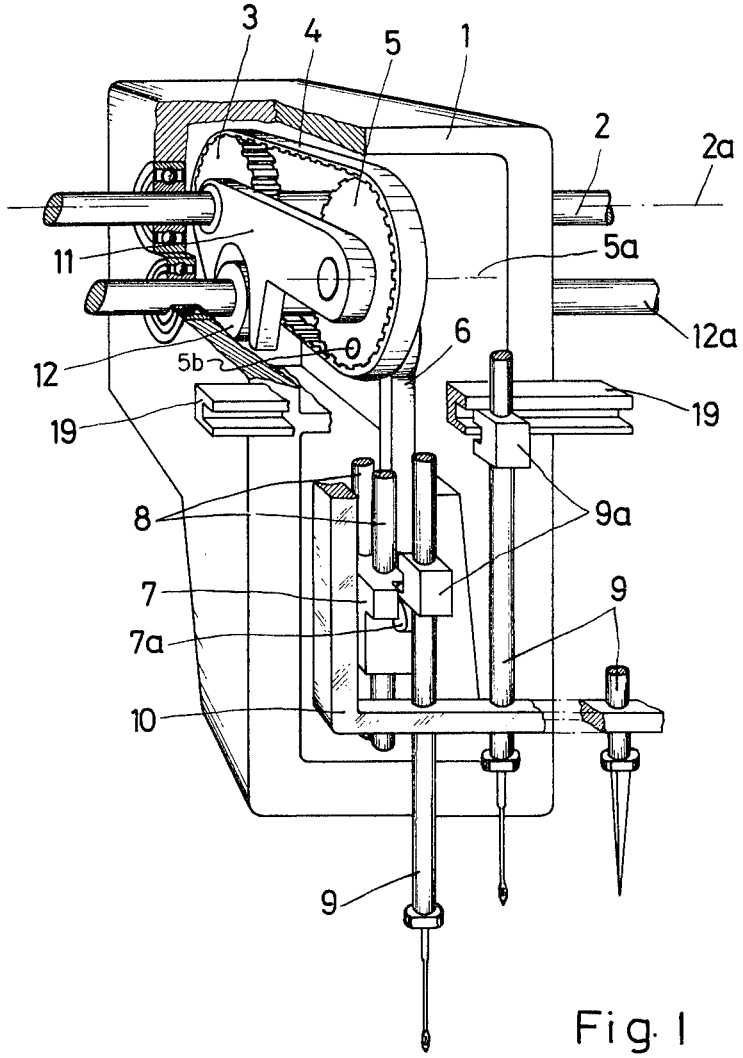
FIG. 1 is a perspective view partially broken away and in section showing a drive device with displacement of the stroke path.
Figure 2:
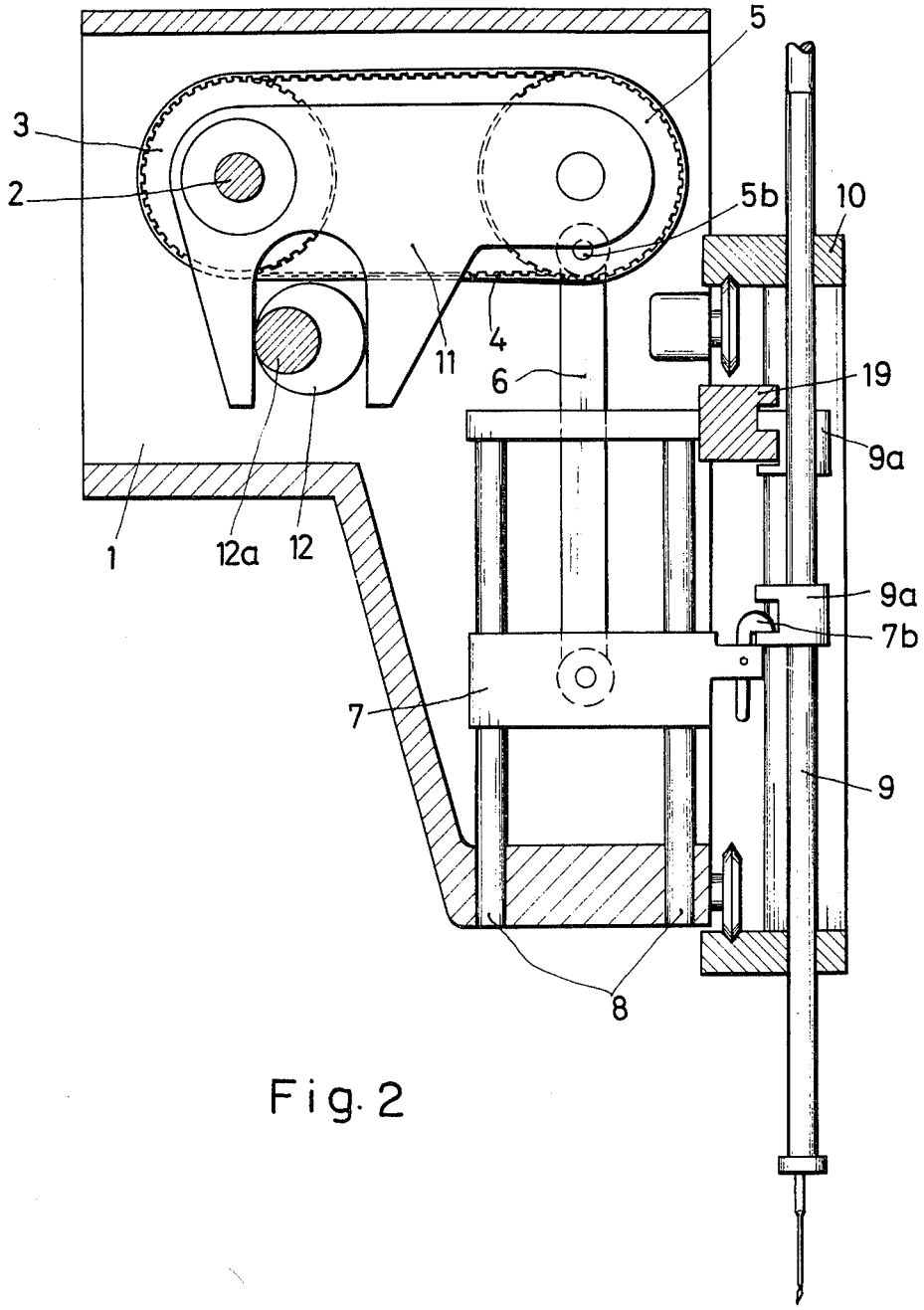
FIG. 2 is a longitudinal section through the embodiment of FIG. 1 with the crank mechanism located in the uppermost position.
Figure 3:
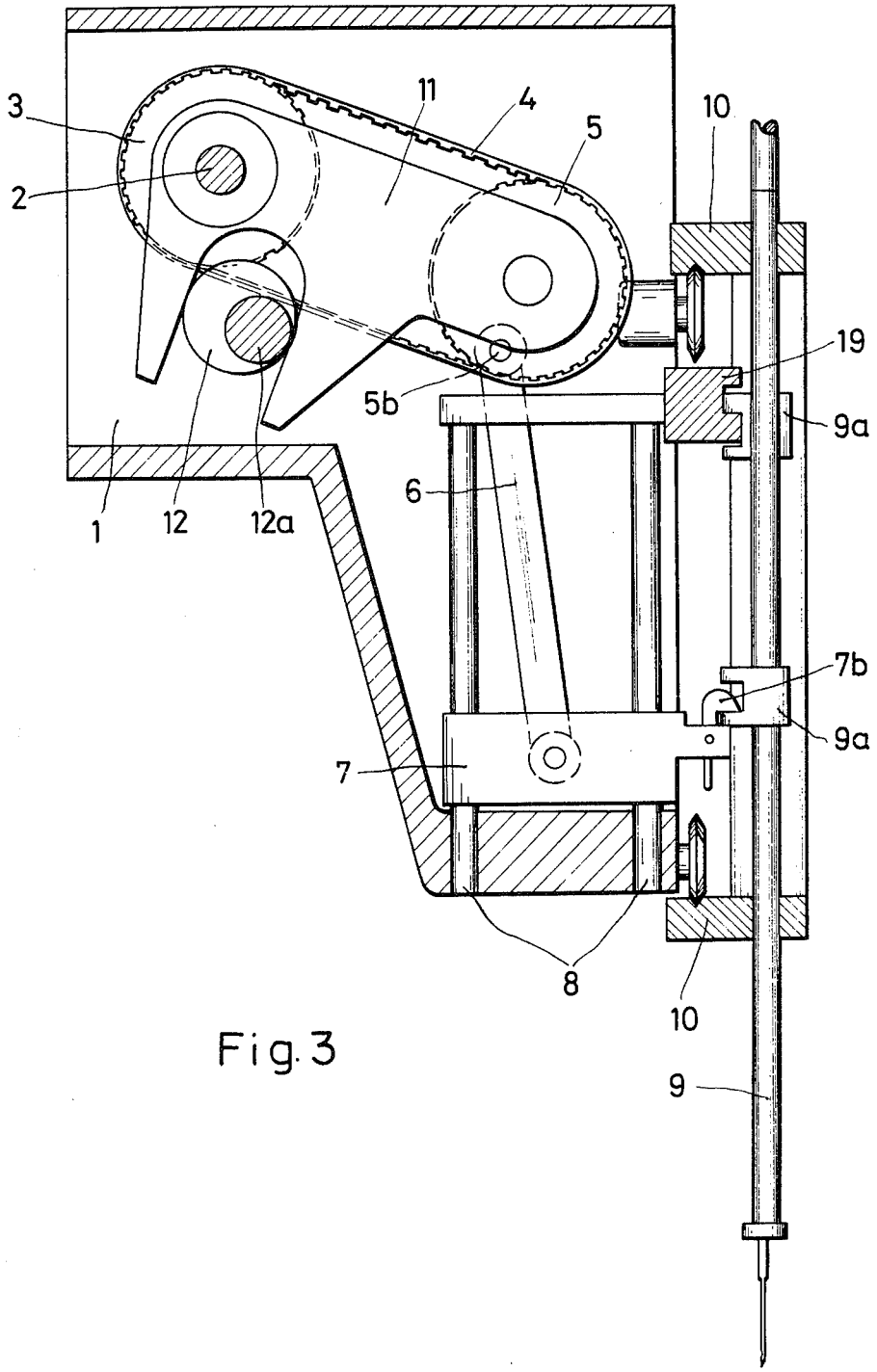
FIG. 3 is a longitudinal section corresponding to FIG. 2 but with the crank mechanism displaced downwardly.

In the embodiment of the drive device, shown in FIGS. 1–3, a main drive shaft 2 is rotably mounted in the housing 1 of an embroidery head. On this main drive shaft 2 there is fastened a gear 3 which, via a toothed belt 4, drives a crank wheel 5 which is toothed on its surface. The axis of rotation 5*a* of this crank wheel 5, which is defined by a bearing (11) rotatably mounting the crank wheel, extends parallel to the axis of rotation 2*a* of the main drive shaft 2.

A crank pin 5*b* is arranged eccentrically to the axis of rotation 5*a* of the crank wheel 5 on the crank wheel. A connecting rod 6 is articulated to the crank pin 5*b*. The lower end of this connecting rod 6 engages on a pin 7*a* of a drive carriage 7. In the embodiment shown this drive carriage 7 is displaceably mounted on two mounting bars 8 which are arranged in the lower part of the housing 1.

Parallel to these mounting bars 8 are a plurality of needle bars 9 which are movably supported in a needle-bar carrier 10 in the shape of a frame. This needle-bar carrier 10 is displaceable with respect to the housing parallel to the axis of rotation 2*a* of the main drive shaft 2 so that in each case only one of the needle bars 9 is present in front of the drive carriage 7. This needle bar 9 can be connected to the drive carriage 7 via a coupling member 9*a* on the needle bar 9 and a pawl 7*b* on the drive carriage 7.

The illustration shows the transmission of the moment of rotation from the main drive shaft 2 to the crank drive mechanism, comprising crank wheel 5, crank pin 5*b* and connecting rod 6. This is effected in a very simple manner since the toothed belt 4 connects the gearwheel 3, which is fastened to the main drive shaft 2, directly to the crank wheel 5. Thus power-consuming transmission paths, which furthermore produce noise, are eliminated so that the drive has a high efficiency with little noise and the smallest possible wear.

The crank wheel 5 is not supported fixed in position in the housing 1, but is mounted on a rocker 11 which forms and defines the bearing for rotatably mounting the crank wheel 5. The rocker 11 is swingably mounted around the axis of rotation 2*a* of the main drive shaft 2. The swinging motion of the rocker 11 is effected by a displacement cam or eccentric 12 which engages into a recess of the rocker 11 and which is fastened on a displacement shaft 12*a*.

The longitudinal section of FIG. 2 shows how the displacement eccentric 12 holds the rocker 11 in a fixed horizontal position. In this position the needle bar 9, which is coupled with the drive carriage 7 by means of the coupling member 9*a* and the pawl 7*b*, is driven with a stroke which corresponds to twice the distance between the crank pin 5*b* and the axis of rotation 5*a* of the crank wheel 5. This stroke is carried out in the highest position of the stroke, as can be noted in FIG. 2 from the fact that the drive carriage 7 when in its lowest position is still above the lower end of the mounting bars 8 arranged in the housing 1.

In the position of FIG. 3, the rocker 11 has been swung into its lowest position by the displacement eccentric 12. The stroke of the needle bar 9, which stroke remains the same in magnitude, has been displaced downwardly in this way, namely by turning the displacement shaft 12*a* which carries the displacement eccentric 12. FIG. 3 shows that in this position of the rocker 11 the drive carriage 7 almost rests in its lowermost position against the bottom part of the housing 1. A comparison of the two lowermost positions of the drive carriage 7 in FIGS. 2 and 3 shows the amount of displacement of the stroke which can be obtained by the rocker 11.

Figure 4:
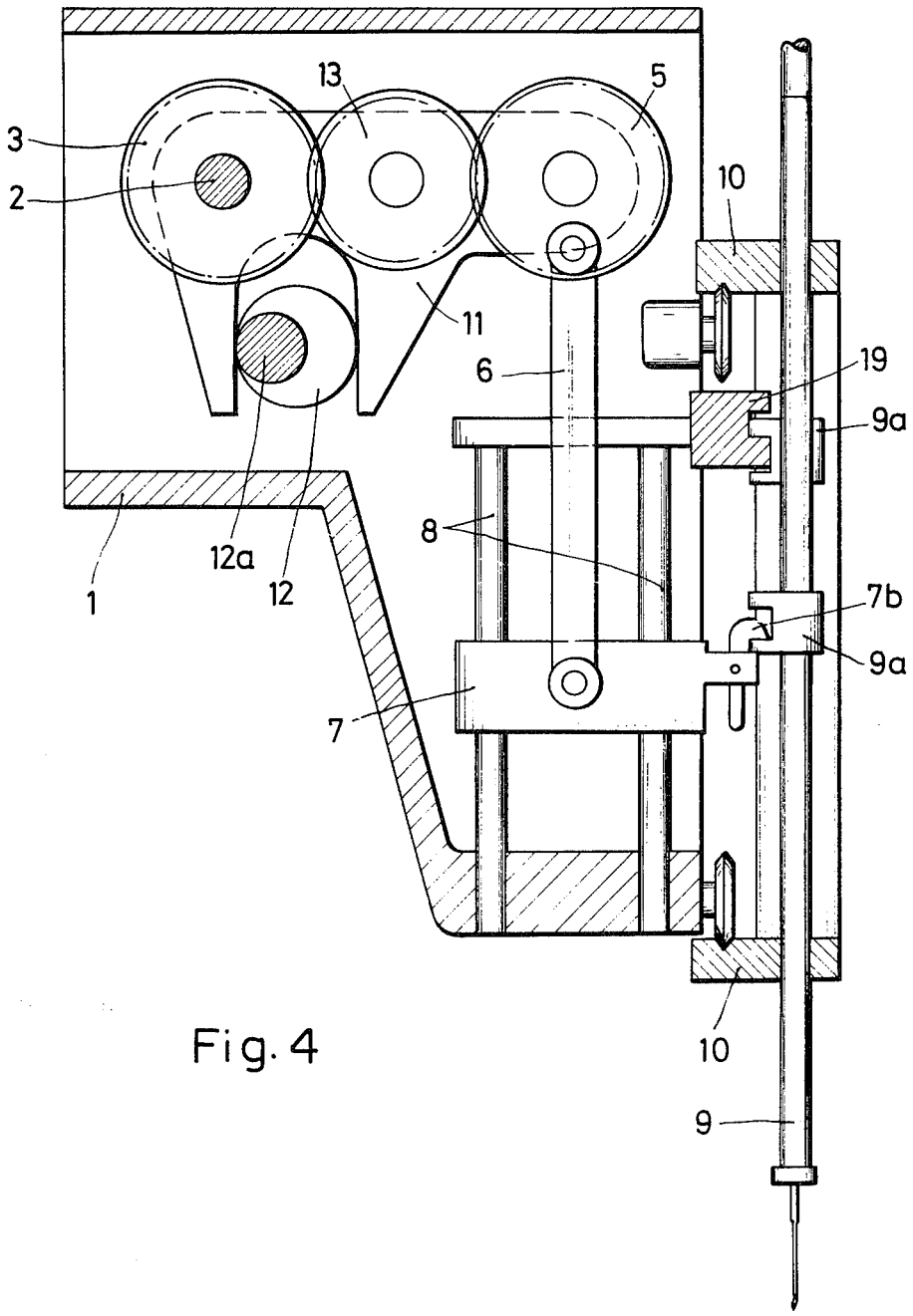
FIG. 4 is a modified embodiment of the drive between main drive shaft and crank wheel in a position corresponding to FIG. 2.
Figure 5:
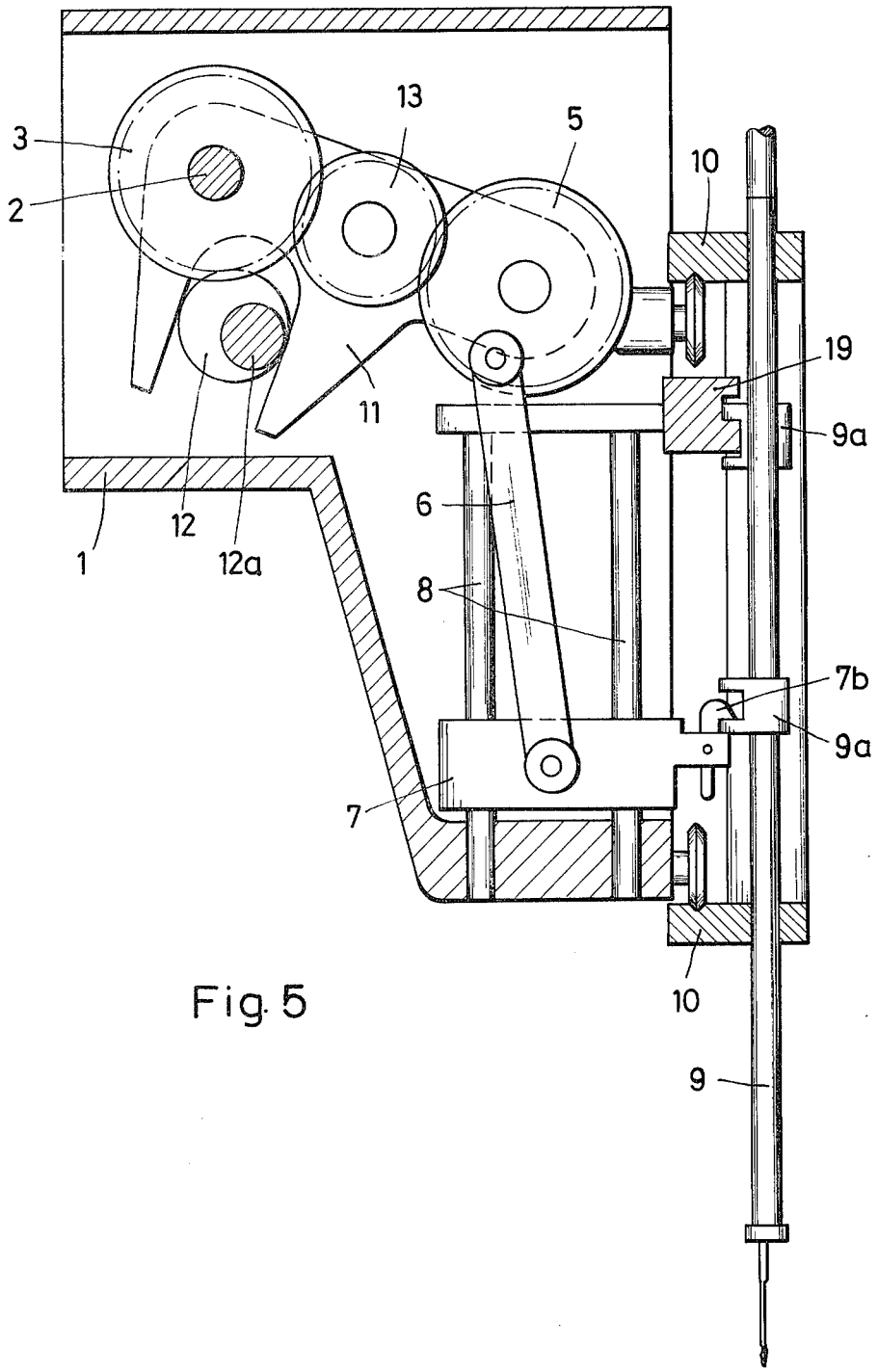
FIG. 5 shows the embodiment of FIG. 4 in a position corresponding to FIG. 3.

The embodiment of the drive device which is shown in FIGS. 4 and 5 corresponds in all essential details to the embodiment of FIGS. 1 to 3. The only difference is the drive of the crank wheel 5 from the main drive shaft 2. While in the embodiment of FIGS. 1 to 3 this drive is effected by a toothed belt 4, in the embodiment of FIGS. 4 and 5 an additional gearwheel 13 is arranged on the rocker 11, this gearwheel 13 connecting the gearwheel 3 which is fastened on the main drive shaft 2 and the crank wheel 5 which is also a gearwheel.

Figure 6:
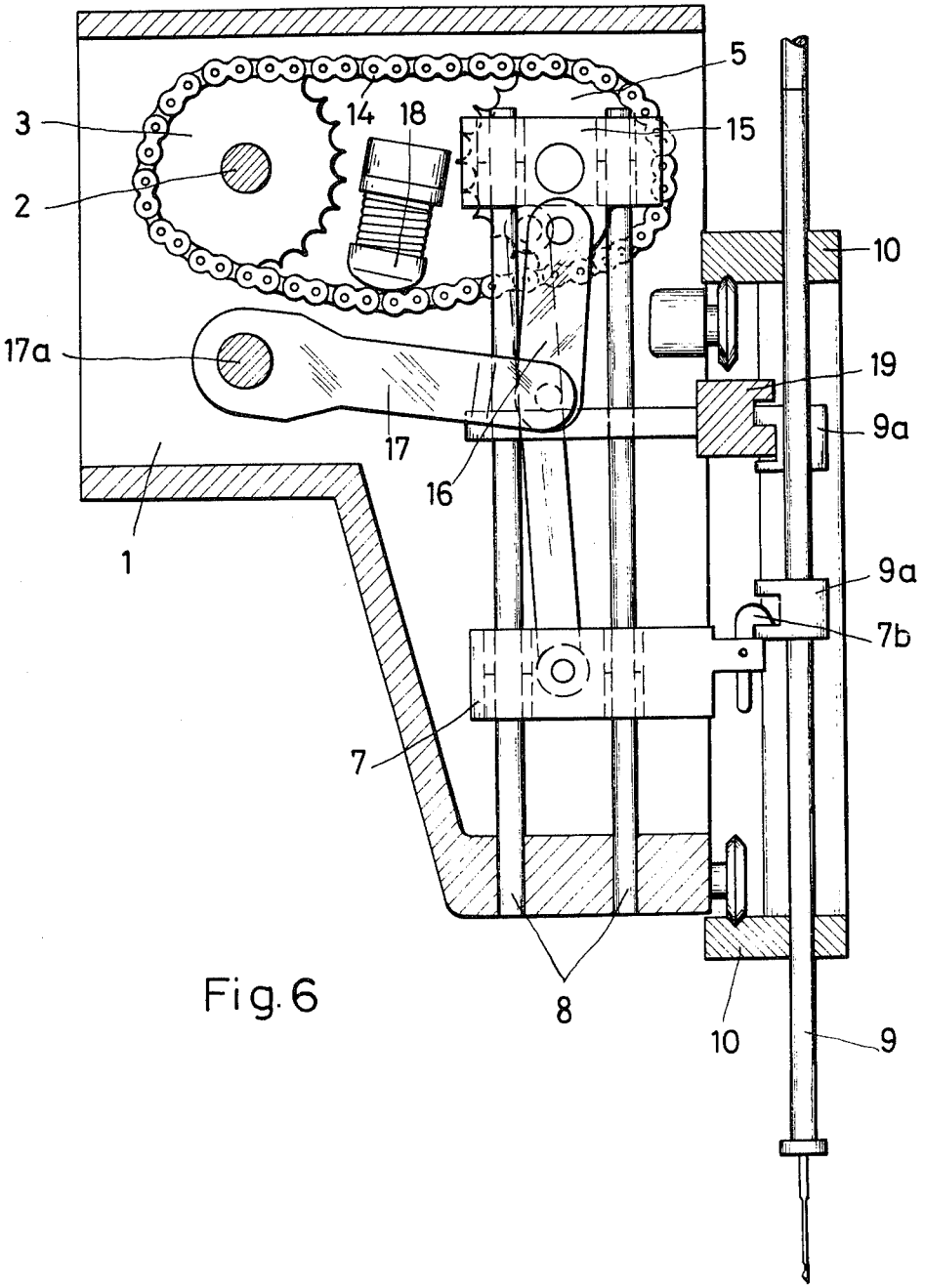
FIG. 6 shows another embodiment of a drive device with displacement of the stroke length, with the crank wheel in the uppermost position.
Figure 7:
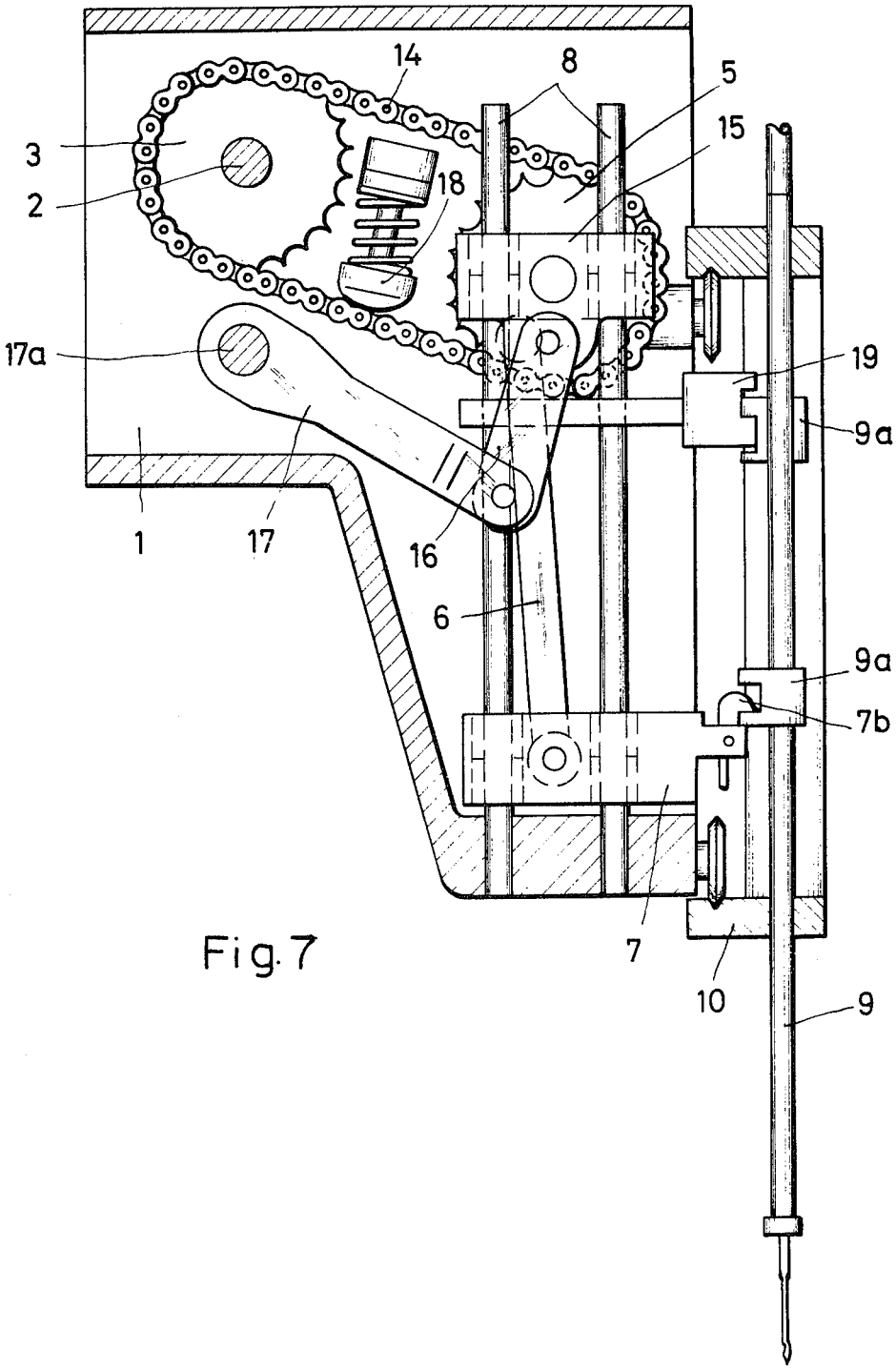
FIG. 7 shows the drive device of FIG. 6 with the stroke shifted downward.

The embodiment in accordance, finally, with FIGS. 6 and 7 shows a modified embodiment for the vertical displacement of the crank wheel 5. As in the previous embodiment, mounting bars 8 which are parallel to the needle bars 9 are provided for the drive carriage 7 which is displaceably mounted on the mounting bars 8. In this embodiment the mounting bars 8 extend vertically upwardly adjacent to the crank wheel 5. This crank wheel 5, which is formed as a sprocket wheel and is driven by a chain 14 and gearwheel 3 by the main drive shaft 2, is rotatably mounted on a mounting member 15 which is vertically displaceable mounted on the upper portion of the mounting bars 8. The mounting member 15 is formed with the bearing which rotatably mounts the crank wheel 5. In the embodiment shown, the vertical displacement of the mounting member 15 is effected by means of a connecting lever 16 pivotally connected to a swing lever 17 which in turn is fastened on a displacement shaft 17*a*. By turning the displacement shaft 17*a* a vertical displacement of the mounting member 15 and thus of the crank wheel 5 are effected. This shifts the stroke path of the drive carriage 7.

Since a change, although only slight, occurs in the distance between the axis of rotation of the main drive shaft 2 and the axis of rotation of the crank wheel 5 when the mounting member 15 is displaced on the mounting bars 8, a chain tensioner 18 is provided in the embodiment of FIGS. 6 and 7. The tensioner on the one hand produces the necessary tension in the chain and on the other hand makes possible the equalization in length necessary upon a vertical displacement of the mounting member 15.

In all three embodiments of the drive device provided with means for displacement of the stroke path in accordance with the invention, a stationary holding rail 19 is arranged on the end side of the housing 1 parallel to the direction of movement of the needle-bar carrier 10. This holding rail 19, which is formed in only two parts which are spaced apart in the region of the connecting rod 6 (cf. FIG. 1), serves to hold those needle bars 9 which are uncoupled at the time from the drive carriage 7, fixed in the upper end position by means of their respective coupling members 9*a*. In the embodiments shown in the drawing, this is effected by a groove in the U-shaped holding rail 19 into which a part of the coupling member 9*a* of each needle bar 9 engages. For this purpose it is necessary for the connecting rod 6 to be in the upper dead center position.

Upon a lateral displacement of the needle bar carrier 10, those needle bars 9 which are disconnected at the time in this manner remain in the upper end position since their coupling members 9*a* slide in the holding rail 19 upon a movement of a needle-bar carrier 10. If a removal of a needle bar 9 which is to be disconnected and a reception of a disconnected needle bar 9 for coupling to the drive carriage 7 are to occur when the stroke path has been shifted in the direction towards the table of the embroidery machine, the rocker 11 or the mounting member 15 must be brought for a short time into the upper end position by means of the adjustment shafts 12*a* and 17*a* respectively before the needle-bar carrier 10 is displaced laterally to change the needle bar 9 which is to be driven. Since the displacement of the rocker 11 and of the mounting member 15 via the displacement shafts 12*a* and 17*a* respectively can be performed not only by hand but, by means of a motor-driven setting drive, even from the main drive of the embroidery machine, for example by information on a punch tape, no substantial amount of time is required for such a displacement of the stroke path.

We claim:

1. In a device for driving at least one needle bar on embroidery or sewing machines having a main drive shaft which extends at a right angle to the longitudinal axis of the needle bar and substantially parallel to a front side of the machine and by which main drive shaft, by means of a drive carriage, which drive carriage is guided parallel to the longitudinal axis of a needle of the needle bar, the needle is drivable by means of a crank drive, which crank drive comprises a connecting rod which drives the drive carriage back and forth defining a stroke and a crank which is operatively rotatingly driven by the main drive shaft, the improvement comprising a bearing means for rotatably mounting said crank and defining an axis of rotation of the crank which axis is parallel to the main drive shaft, and means for vertically displacing said bearing means of the axis of rotation of the crank, whereby the stroke is vertically displaceable with the magnitude of the stroke remaining the same.

2. The device according to claim 1, further comprising a rocker forming said bearing means, wherein said crank is mounted on said bearing means on said rocker, and said rocker is pivotally mounted around the axis of rotation of the main drive shaft and constitutes said vertically displacing means.

3. The device according to claim 2, wherein said displacing means is a displacement eccentric means for pivoting said rocker.

4. The device according to claim 1, further comprising a mounting member constituting said bearing means, said crank comprising a crank wheel mounted on said mounting member via said bearing means, and means comprising at least one mounting bar for vertically displaceably guiding said mounting member thereon.

5. The device according to claim 4, wherein said means comprising at least one mounting bar constitutes two mounting bars which are arranged parallel to said needle bar.

6. The device according to claim 1, wherein said crank drive includes actuating means for operatively actuating said crank via said main drive shaft.

7. The device according to claim 6, wherein said actuating means comprises a toothed belt engaging said crank.

8. The device according to claim 6, wherein said actuating means comprises a chain engaging said crank.

9. The device according to claim 6, wherein said actuating means comprises a wheel mechanism engaging said crank.

10. The device according to claim 9, wherein said wheel mechanism comprises a first gearwheel jointly rotatably fastened to said main drive shaft, and another gearwheel engages with said first gearwheel and said crank, the latter constituting a gearwheel.

11. The device according to claim 1 for use on said machines having a plurality of said needle bars which are mounted parallel to each other in a needle bar carrier, the needle bar carrier being mounted displaceably in a movement direction transversely to an embroidery direction, respectively one of said needle bars, by means of a coupling member, being coupleable with the drive carriage, the latter being guided on a guide bar, the guide rod extending parallel to and behind the needle bars, comprising means comprising said coupling member for coupling said one needle bar to said drive carriage from time to time, a plurality of said coupling members, one of the latter each is mounted on one of said needle bars, respectively, a stationary holding rail is arranged parallel to the movement direction of the needle bar carrier, said bearing means defining a highest position for the axis of rotation of the crank, said means comprising said coupling members of said needle bars which are at the time operatively disconnected from said drive carriage, for transferring to said stationary holding rail at said highest position.

12. The device according to claim 1, wherein said displacing means is further for holding said bearing means in different respective vertically displaced positions.

13. In a device for driving at least one needle bar supported on an embroidery or sewing machine frame wherein said needle bar is driven by a drive shaft by means of a crank mechanism, the improvement comprising:

a bearing means for mounting said crank mechanism, adjustment means associated with said bearing means to change the displacement of the needle bar from a bottom frame surface, and said bearing means supported in said machine frame so that the needle bar stroke length remains constant when said change in needle bar displacement is effected.

14. The device according to claim 13, wherein said crank mechanism has an axis of rotation disposed parallel to said drive shaft, said bearing means defines said axis of rotation of said crank mechanism, said bearing means is displaceable in height, said bearing means is a bearing member, said crank mechanism is mounted on said bearing member, and means comprising at least one mounting bar for vertically displaceably guiding said bearing member thereon.

15. The device according to claim 14, wherein said means comprising at least one mounting bar constitutes two mounting bars which are arranged parallel to said needle bar.

16. The device according to claim 13, wherein said crank mechanism has an axis of rotation disposed parallel to said drive shaft, said bearing means defines said axis of rotation of said crank mechanism, said bearing means is displaceable in height, said crank mechanism includes, a crank wheel, a connecting rod is operatively connected to said at least one needle bar, an eccentric crank pin connects said crank wheel eccentrically to said connecting rod, means for driving said crank wheel from said drive shaft, and said driving means is a toothed belt.

17. The device according to claim 13, wherein said crank mechanism has an axis of rotation disposed parallel to said drive shaft, said bearing means defines said axis of rotation of said crank mechanism, said bearing means is displaceable in height, said crank mechanism includes, a crank wheel, a connecting rod is operatively connected to said at least one needle bar, an eccentric crank pin connects said crank wheel eccentrically to said connecting rod, means for driving said crank wheel from said drive shaft, and said driving means is a chain.

18. The device according to claim 13, wherein said crank mechanism has an axis of rotation disposed parallel to said drive shaft, said bearing means defines said axis of rotation of said crank mechanism, said bearing means is displaceable in height, said crank mechanism includes, a crank wheel, a connecting rod is operatively connected to said at least one needle bar, an eccentric crank pin connects said crank wheel eccentrically to said connecting rod, means for driving said crank wheel from said drive shaft, and said driving means is a gear drive.

19. The device according to claim 13, wherein said crank mechanism has an axis of rotation disposed parallel to said drive shaft, said crank mechanism includes, a crank wheel, a connecting rod is operatively connected to said at least one needle bar, an eccentric crank pin connects said crank wheel eccentrically to said connecting rod, means for driving said crank wheel from said drive shaft, and said driving means is a toothed belt.

20. The device according to claim 13, wherein said crank mechanism has an axis of rotation disposed parallel to said drive shaft, said crank mechanism includes, a crank wheel, a connecting rod is operatively connected to said at least one needle bar, an eccentric crank pin connects said crank wheel eccentrically to said connecting rod, means for driving said crank wheel from said drive shaft, and said driving means is a chain.

21. The device according to claim 13, wherein said crank mechanism has an axis of rotation disposed parallel to said drive shaft, said crank mechanism includes, a crank wheel, a connecting rod is operatively connected to said at least one needle bar, an eccentric crank pin connects said crank wheel eccentrically to said connecting rod, means for driving said crank wheel from said drive shaft, and said driving means is a gear drive.

* * * * *